US010986453B2

(12) United States Patent
Santek et al.

(10) Patent No.: US 10,986,453 B2
(45) Date of Patent: Apr. 20, 2021

(54) VARIABLE TRANSDUCER FIXATION

(71) Applicant: MED-EL Elektromedizinische Geraete GmbH, Innsbruck (AT)

(72) Inventors: Michael Santek, Innsbruck (AT); Thomas Lechleitner, Polling (AT)

(73) Assignee: MED-EL Elektromedizinische Geraete GmbH, Innsbruck (AT)

( * ) Notice: Subject to any disclaimer, the term of this patent is extended or adjusted under 35 U.S.C. 154(b) by 358 days.

(21) Appl. No.: 16/069,232

(22) PCT Filed: Feb. 3, 2017

(86) PCT No.: PCT/US2017/016338
§ 371 (c)(1),
(2) Date: Jul. 11, 2018

(87) PCT Pub. No.: WO2017/136619
PCT Pub. Date: Aug. 10, 2017

(65) Prior Publication Data
US 2019/0037322 A1 Jan. 31, 2019

Related U.S. Application Data

(60) Provisional application No. 62/291,559, filed on Feb. 5, 2016.

(51) Int. Cl.
*H04R 25/00* (2006.01)

(52) U.S. Cl.
CPC ..... *H04R 25/606* (2013.01); *H04R 2225/67* (2013.01); *H04R 2460/13* (2013.01)

(58) Field of Classification Search
CPC ..... H04R 25/606; H04R 2460/13; H04R 2225/67; H04R 25/60; H04R 25/65
See application file for complete search history.

(56) References Cited

U.S. PATENT DOCUMENTS

2010/0042119 A1* 2/2010 Simms ..... H04R 25/606 606/151
2012/0271097 A1 10/2012 Ball et al.
(Continued)

FOREIGN PATENT DOCUMENTS

WO WO 2017/136619 A1 8/2017

OTHER PUBLICATIONS

International Searching Authority/US, International Search Report and the Written Opinion of the International Searching Authority, Application No. PCT/US2017/016338, dated Apr. 24, 2017, 13 pages.

(Continued)

*Primary Examiner* — Kaylee R Wilson
(74) *Attorney, Agent, or Firm* — Sunstein LLP

(57) ABSTRACT

An implantable bone conduction transducer arrangement includes a transducer housing having an outer surface with a side wall and opposing ends. A pair of fixation projections are connected to the transducer housing at one end. Each fixation projection includes a bone screw opening configured for insertion of a bone fixation screw to engage underlying skull bone. At least one fixation projection is configured to be independently moveable relative to the transducer housing to form an adjustable relative position between the fixation projections.

15 Claims, 5 Drawing Sheets

(56) References Cited

U.S. PATENT DOCUMENTS

| | | | |
|---|---|---|---|
| 2013/0046131 | A1 | 2/2013 | Ball et al. |
| 2013/0096366 | A1 | 4/2013 | Bervoets et al. |
| 2014/0121452 | A1 | 5/2014 | Kasic et al. |

OTHER PUBLICATIONS

European Patent Official, Partial Supplementary European Search Report, Application No. 17748200.7, dated Jul. 23, 2019, 13 pages.

* cited by examiner

VARIABLE TRANSDUCER FIXATION

This application is a National Phase Entry of Patent Cooperation Treaty Application PCT/US2017/016338, filed Feb. 3, 2017, which in turn claims priority from U.S. Provisional Patent Application 62/291,559, filed February 5, both of which are incorporated herein by reference in their entireties.

FIELD OF THE INVENTION

The present invention relates to hearing implants, and more specifically to fixation of a bone conduction floating mass transducer to a patient's skull bone.

BACKGROUND ART

A normal ear transmits sounds as shown in FIG. 1 through the outer ear 101 to the tympanic membrane (eardrum) 102, which moves the ossicles of the middle ear 103 (malleus, incus, and stapes) that vibrate the oval window 106 and round window 107 membranes of the cochlea 104. The cochlea 104 is a long narrow duct wound spirally about its axis for approximately two and a half turns. It includes an upper channel known as the scala vestibuli and a lower channel known as the scala tympani, which are connected by the cochlear duct. The cochlea 104 forms an upright spiraling cone with a center called the modiolar where the spiral ganglion cells of the cochlear nerve 105 reside. In response to received sounds transmitted by the middle ear 103, the fluid-filled cochlea 104 functions as a transducer to generate electric pulses which are transmitted to the cochlear nerve 105, and ultimately to the brain.

Hearing is impaired when there are problems in the ability to transduce external sounds into meaningful action potentials along the neural substrate of the cochlea 104. To improve impaired hearing, hearing prostheses have been developed. For example, when the impairment is related to operation of the middle ear 103, a conventional hearing aid or middle ear implant may be used to provide acoustic-mechanical stimulation to the auditory system in the form of amplified sound. Or when the impairment is associated with the cochlea 104, a cochlear implant with an implanted stimulation electrode can electrically stimulate auditory nerve tissue with small currents delivered by multiple electrode contacts distributed along the electrode.

U.S. Pat. No. 8,246,532 (incorporated herein by reference in its entirety) described a type of implantable hearing prosthesis system which uses bone conduction to deliver an audio signal to the cochlea for sound perception in persons with conductive or mixed conductive/sensorineural hearing loss. An implanted floating mass transducer (FMT) is affixed to the temporal bone. A body worn audio processor, typically behind the ear, receives via microphones the audio signals and transforms it into an electrical audio signal. In response to an externally generated electrical audio signal, the FMT couples a mechanical stimulation signal to the temporal bone for delivery by bone conduction to the cochlea for perception as a sound signal. A certain amount of electronic circuitry must also be implanted with the FMT to provide power to the implanted device and at least some signal processing which is needed for converting the external electrical signal into the mechanical stimulation signal and mechanically driving the FMT.

To generate the mechanical vibration forces needed in a bone conduction transducer, an oscillating mass is used, which also has corresponding space requirements. In addition, the connection of a bone conduction transducer to the cranial bone must be very stable, since relatively large forces must be transferred to the skull bone. Typically this involves osseointegration of certain implant features.

Most existing bone conduction implants use two standard bone screws to attach the transducer to the patient's skull bone. This screw fixation arrangement requires sufficient space, additional parts, and sometimes can involve additional bone drilling (needing a longer surgical procedure). In addition, it is important that the geometry of the screw holes be correct, and that the structure and geometry of skull bone be appropriate.

A proper site for the implanted transducer has to be provided on the cranial bone during the implant surgery. On the outward-facing side of the implant, tension created on the skin by protruding structures is the limiting factor. On the inward-facing side of the implant are anatomical structures within the skull bone (blood vessels, nerves, etc.) and the dura mater of the brain. Each surgery involves a balancing between the burden to the skin over the transducer together with the desire to drill out as little as possible of the underlying skull bone.

The choice of placement location for the transducer and the corresponding drilling depth is limited. Current commercial products do not provide for a variable/adjustable implant means of fixation. For example, fixation of the Bonebridge transducers sold by Vibrant Med-El are designed so that the screw connection to the skull bones of the entire transducer must be opposite each other. These require a comprehensive pre-operative examination and sometimes intra-operative surgical adjustments are necessary. In addition, the depth and positioning of the bone connection screws in the skull bone depends upon specific patient anatomical factors as well as the designated screw receptacle holes provided on the body of the implant housing. The BCI lifts provided with the Bonebridge transducer allow partial sinking of the device into the skull bone, which reduces the depth of bone removal that is needed.

U.S. Pat. No. 8,241,201 describes various bone conduction transducer arrangements including an embodiment with a non-screw fixation mechanism where an adaptor made of biocompatible material is placed between the bottom of the transducer housing and the underlying bone. WO 2014138149 describes various different fixation features on the outer perimeter of a cochlear implant housing. U.S. Pat. No. 8,909,348 also shows a cochlear implant with stabilizing projections on its outer perimeter. U.S. Pat. No. 7,937,156 shows another cochlear implant housing with various osseointegrating projections.

SUMMARY

Embodiments of the present invention are directed to an implantable bone conduction transducer arrangement. A transducer housing has an outer surface with a side wall and opposing ends. A pair of fixation projections are connected to the transducer housing at one end. Each fixation projection includes a bone screw opening configured for insertion of a bone fixation screw to engage underlying skull bone. At least one fixation projection is configured to be independently moveable relative to the transducer housing to form an adjustable relative position between the fixation projections.

In specific embodiments, there may also be a pair of projection rings, each projection ring including one of the fixation projections. In such an embodiment, the projection rings are connected to the generally cylindrical shaped transducer housing with a central cylindrical axis at the side wall and at least one projection ring is configured to be rotatable relative to the transducer housing about the cylindrical axis so that an adjustable relative arc exists between the fixation projections. Both fixation projections may be configured to be independently rotatable relative to the transducer housing about the cylindrical axis.

Each fixation projection may further include a locking tab configured to slide away from the bone screw opening when a bone screw is inserted into the bone screw opening and engage against the outer surface of the transducer housing to resist movement of the transducer housing relative to the fixation projection. Each such locking tab may include a spring element configured for controlling engaging force of the locking tab against the outer surface of the transducer housing. And each locking tab may further include one or more handling tabs configured for engaging a surgical tool for squeezing the spring element to allow removal of the transducer housing from at least one fixation projection or ring and bone screws.

The fixation projections may be connected at an inner end of the transducer housing configured to fit against underlying skull bone, or at an outer end of the transducer housing furthest away from underlying skull bone. The transducer housing may be configured to be disconnectable from the fixation projections or rings without removing the bone fixation screws. The fixation projections or rings may be covered with a surface treatment for promoting osseointegration of the fixation projections with adjacent skull bone. And the transducer housing may specifically have a generally rectangular or cylindrical shape with a center cylindrical axis and opposing cylindrical ends.

DETAILED DESCRIPTION

Embodiments of the present invention are directed to arrangements for fixing a bone conduction transducer such as an FMT to an implanted patient's skull bone with an adjustable angle between the bone fixation screws, which allows the fixation of the bone conduction transducer to the skull bone to be individually adapted to the specific anatomy of the recipient patient.

Figure 1:
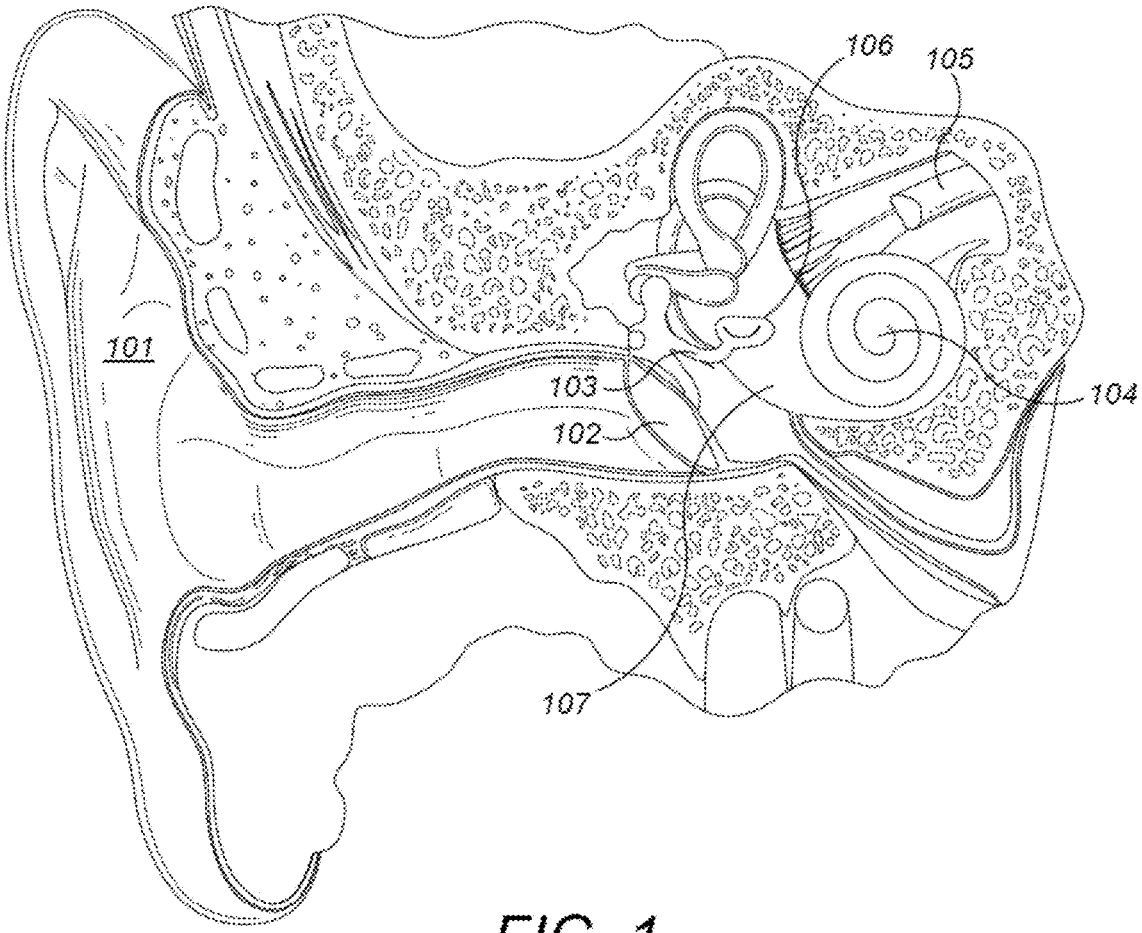
FIG. 1 shows anatomical structures of a typical human ear.
Figure 2:
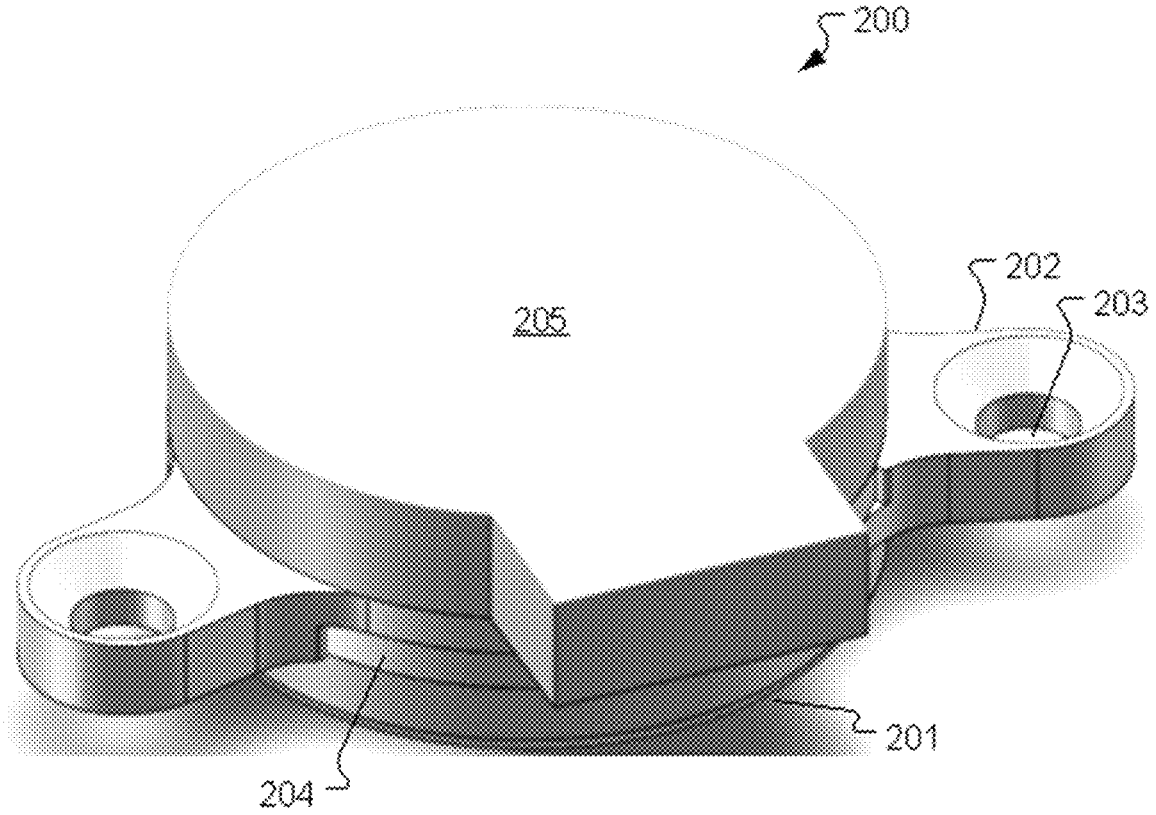
FIG. 2 shows an elevated perspective view of an implantable bone conduction transducer arrangement according to an embodiment of the present invention.

FIG. 2 shows an elevated perspective top view of an implantable bone conduction transducer arrangement which includes a generally cylindrical transducer housing 200 with a center cylindrical axis. Note that the transducer housing 200 has an outer surface that may include one or more eccentric projection lobes as is shown in FIG. 2, which may be useful for example to accommodate the implant electronic circuits contained within the transducer housing 200. The transducer housing 200 also has opposing cylindrical ends, inner end 201 and outer end 205.

A pair of fixation projections 202 are connected to the transducer housing 200 at one cylindrical end. Each fixation projection 202 includes a bone screw opening 203 that is configured for insertion of a bone fixation screw to engage underlying skull bone. The fixation projections 202 are configured to be independently rotatable about the cylindrical axis of the transducer housing 200 so that an adjustable rotational arc exists between them. This has the advantage that an eccentric projection lobe form the transducer housing 200 may be positioned completely independent from the bone fixation screw. If is however understood, that only one fixation projection may be rotatable about the cylindrical axis of the transducer housing 200. In the specific embodiment shown in FIG. 2, the fixation projections 202 are formed in independently rotatable projection rings 204 that rotate on the outer surface of the transducer housing 200 around the cylindrical axis so that an adjustable rotational arc exists between the fixation projections 202. Each projection ring 204 has one of the fixation projections 202. The projection rings 204 and their fixation projections 202 may be connected at the inner end 201 of the transducer housing 200 and configured to fit against underlying skull bone, or they may be located at the outer end 205 of the transducer housing 200 furthest away from underlying skull bone.

Figure 3A:
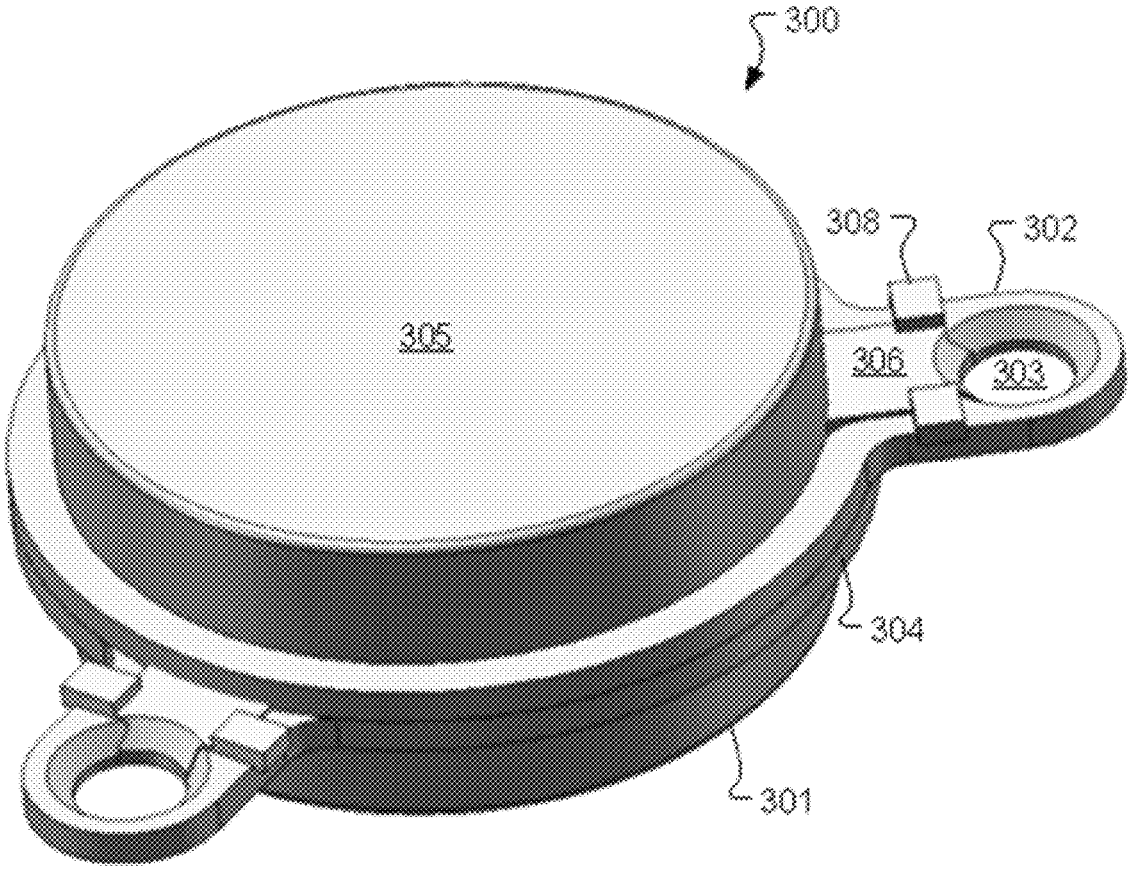
FIGS. 3A-3C show another embodiment with locking tabs.
Figure 3B:
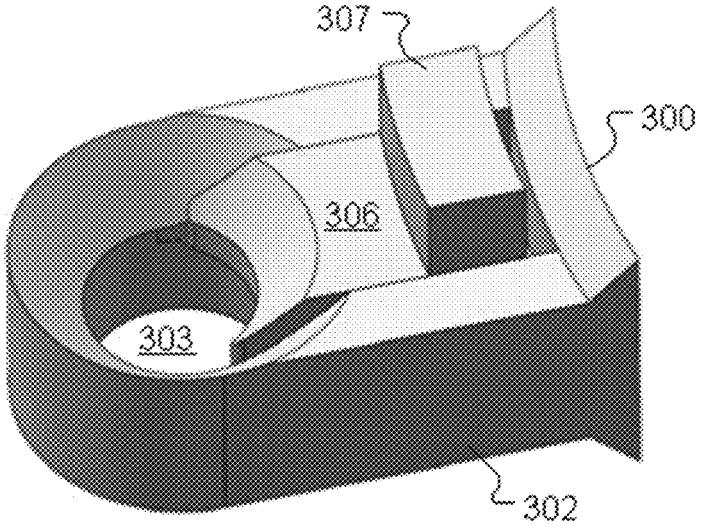
Figure 3C:
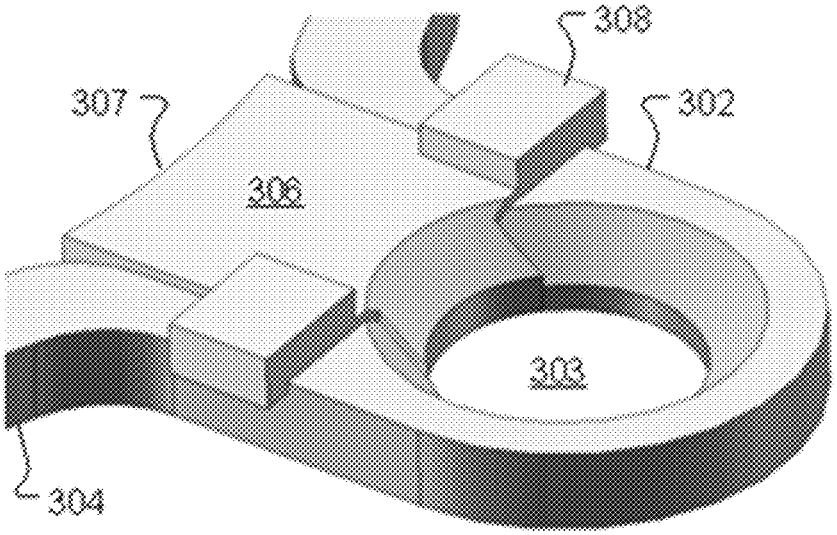

FIG. 3A shows an elevated perspective view of another embodiment of a transducer housing 300 with an inner end 301 and an outer end 305, in which the fixation projections 302 each include a locking tab 306, shown in detail in FIGS. 3B and 3C. The locking tab 306 is configured to slide away along a sliding direction from the bone screw opening 303 when a bone screw is inserted into the bone screw opening 303 and engage its inner edge 307 against the outer surface of the transducer housing 300. The locking tab 306 may have an edge receptacle notch or protrusion 308 that slidably engages into a corresponding edge receptacle protrusion or notch in the fixation projections 302 along the movement direction. For example, in the embodiment of the locking tab 306 shown in FIG. 3B, the inner edge 307 has a flat surface and opposing arranged a slider as part of the fixation projections 302 having a downward facing triangle shape, the edge of which fits into a corresponding edge receptacle notch on the outer surface of the transducer housing 300. When the screw is inserted into the bone screw opening 303 and the locking tab 306 slides away, the inner edge 307 and opposing triangle shape move to each other and thereby clamp the transducer housing 300 in between so as to resist movement relative to the fixation projections 302. In the embodiment shown in FIG. 3C, the inner edge 307 has an inner edge 307 that faces radially inward to engage on the outer surface of the transducer housing 300. The transducer housing 300 may have a corresponding edge receptacle notch on the outer surface where the inner edge 307 may engage (not shown). In some embodiments, the structure and geometry of such edge receptacle notches may be adapted to allow adding the fixation projections 302 during the implantation surgery. Such providing of multiple edge receptacle notches on the outer surface of the transducer housing 300 would enable greater selection for the exact location of the fixation projections 302.

The locking tabs 306 may be made, for example, of moldable polymer material such as polyether ether ketone (PEEK), or of bio-compatible metal (e.g. titanium, MP35N). The fixation projection 302, bone screw opening 303, and locking tab 306 may be configured to allow the locking tab to simply snap into position within the bone screw opening 303 during assembly. The locking tab 306 may also include a spring element (not shown) that may help control the clamping force of the locking tab 306 against the outer surface of the transducer housing 300.

In specific embodiments, the transducer housing 200/300 may be configured to be disconnectable from one or both fixation projections 202/302 and/or the projection rings 204/304. Thus, the locking tab 306 may include a pair of handling tabs that can be used to engage surgical forceps to squeeze the spring element of the locking tab 306 along the movement direction together to allow the inner edge 307 of the locking tab 306 to be pulled back from transducer housing 200/300 and allow for separate removal of the transducer housing 200/300 without removing the projection rings 204/304 and/or fixation projections 202/302 and the bone fixation screws.

And in some embodiments, the fixation projections 202/302 may be covered with a surface treatment for promoting osseointegration of the fixation projections 202/302 with adjacent skull bone. For example, the projection rings 204/304 may be made of titanium with a surface coating that promotes osseointegration of the projection rings 204/304 and the fixation projections 202/302 with the underlying skull bone. The outer surface of the remainder of the transducer housing 200/300 is uncoated, thereby avoiding osseointegration of the main body of the transducer housing 200/300, and enabling its convenient disconnection during a second surgery; for example, to repair/replace the electronic circuits contained within.

Figure 4:
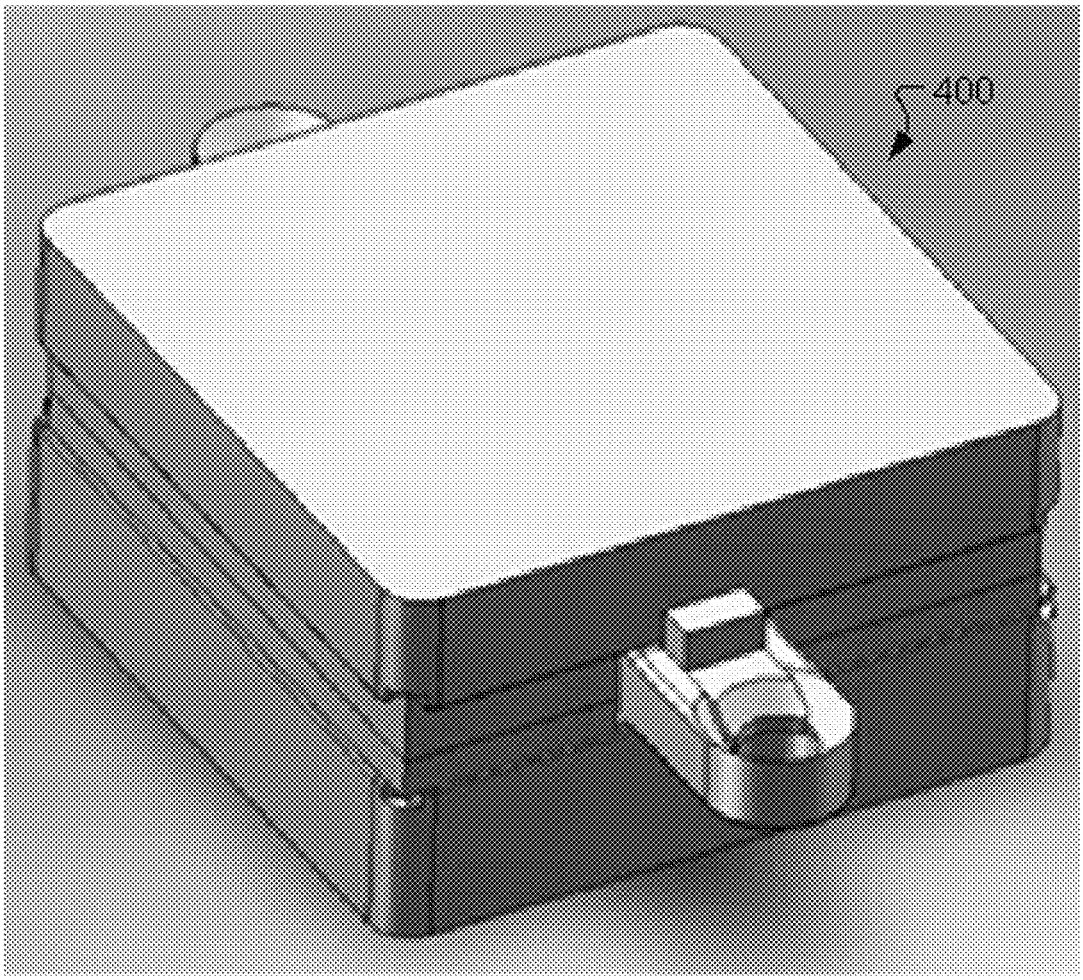
FIG. 4 shows an example of a square shaped transducer housing.

Of course, the use of such fixation projections is not limited to transducer housings that specifically are more or less cylindrical. For example, FIG. 4 shows an embodiment of a square shaped transducer housing 400, and other specific shapes are equally conceivable. In this specific example the outer surface of the transducer housing 400 has an edge receptacle notch on its side wall for slidable engaging the fixation projections 300. The edge receptacle notch may have openings, here shown at the edges of the side walls to allow for insertion of fixation projections 300 into edge receptacle notch during surgery. This allows, for the example of the square shaped transducer housing 400, to insert the fixation projections 300 during surgery onto the side wall where the bone screw fixation is best suited. Similarly the transducer housing 400 may be removable from the fixation projections 300 without removing bone fixation screws as described before and as long as the fixation projections 300 are slidable in parallel direction. Otherwise only those fixation projections 300 with non-parallel slidable direction may be removed by opening bone fixation screw first, the other fixation projections 300 may stay in place. It is however readily understood, that such openings may be equally used in other specific shapes, for example cylindrical shaped transducer housings 400, that would enable greater selection of desired number of fixation projections and for exact location of the fixation projections 302.

Although various exemplary embodiments of the invention have been disclosed, it should be apparent to those skilled in the art that various changes and modifications can be made which will achieve some of the advantages of the invention without departing from the true scope of the invention.

What is claimed is:

1. An implantable bone conduction transducer arrangement comprising:

a transducer housing having an outer surface with a side wall, an inner end configured to fit against an underlying skull bone, and an outer end located further away from the underlying skull bone;

a pair of fixation projections connected to the transducer housing at one of the inner end or the outer end, each fixation projection including a bone screw opening configured for insertion of a bone fixation screw to engage underlying skull bone; and a pair of projection rings, each projection ring of the pair of projection rings including a corresponding one of the pair of fixation projections, wherein the pair of projection rings surround a perimeter of the outer surface of the side wall of the transducer housing such that at least one projection ring of the pair of projection rings is configured to be rotatable relative to the transducer housing about an axis so that an adjustable relative arc exists between the pair of fixation projections.

2. The implantable bone conduction transducer arrangement according to claim 1, wherein each fixation projection of the pair of fixation projections includes a corresponding locking tab configured to slide away from the bone screw opening when a bone fixation screw is inserted into the bone screw opening and engage against the outer surface of the transducer housing to resist movement of the transducer housing relative to the fixation projection that includes the corresponding locking tab.

3. The implantable bone conduction transducer arrangement according to claim 1, wherein each locking tab comprises a spring element configured for controlling an engaging force of an associated locking tab against the outer surface of the transducer housing.

4. The implantable bone conduction transducer arrangement according to claim 3, wherein each locking tab further comprises one or more handling tabs configured for engaging a surgical tool for squeezing the spring element to allow removal of the transducer housing from the corresponding fixation projection and bone fixation screw.

5. The implantable bone conduction transducer arrangement according to claim 1, wherein the pair of fixation projections are connected at the inner end of the transducer housing.

6. The implantable bone conduction transducer arrangement according to claim 1, wherein the pair of fixation projections are connected at the outer end of the transducer housing.

7. The implantable bone conduction transducer arrangement according to claim 1, wherein the pair of fixation projections are covered with a surface treatment for promoting osseointegration of the pair of fixation projections with the underlying skull bone.

8. The implantable bone conduction transducer according to claim 1, wherein the transducer housing has a generally rectangular shape.

9. The implantable bone conduction transducer according to claim 1, wherein the transducer housing has a generally cylindrical shape.

10. The implantable bone conduction transducer arrangement according to claim 1, wherein each of the pair of projection rings are configured to be independently rotatable relative to the transducer housing about the axis.

11. The implantable bone conduction transducer arrangement according to claim 1, wherein when a bone fixation screw is inserted into the bone screw opening of at least one of the pair of fixation projections, the transducer housing is configured to be disconnectable from at least a corresponding one of the pair of projection rings without removing the bone fixation screw.

12. An implantable bone conduction hearing prosthesis comprising an external body worn audio processor and a bone conduction implant including a transducer according to one of claims 1-9, 10 and 11.

13. An implantable bone conduction transducer arrangement comprising:

a transducer housing having an outer surface with a side wall, an inner end configured to fit against an underlying skull bone, and an outer end located further away from the underlying skull bone;

a pair of fixation projections connected to the transducer housing at one of the inner end or the outer end, each fixation projection including a bone screw opening configured for insertion of a bone fixation screw to engage underlying skull bone;

wherein at least one fixation projection of the pair of fixation projections is configured to be independently moveable relative to the transducer housing to form an adjustable relative position between the pair of fixation projections, and wherein each fixation projection of the pair of fixation projections includes a locking tab configured to slide away from the bone screw opening when a bone fixation screw is inserted into the bone screw opening and engage against the outer surface of the transducer housing to resist movement of the transducer housing relative to the fixation projection that includes the corresponding locking tab.

14. The implantable bone conduction transducer arrangement according to claim 13, wherein each locking tab comprises a spring element configured for controlling an engaging force of an associated locking tab against the outer surface of the transducer housing.

15. The implantable bone conduction transducer arrangement according to claim 13, wherein each locking tab further comprises one or more handling tabs configured for engaging a surgical tool for squeezing the spring element to allow removal of the transducer housing from the corresponding fixation projection and bone fixation screw.

* * * * *